US006899396B2

(12) United States Patent
Bales

(10) Patent No.: US 6,899,396 B2
(45) Date of Patent: May 31, 2005

(54) CHAIR CONSTRUCTION

(75) Inventor: David W. Bales, Tucson, AZ (US)

(73) Assignee: Mercuries Asia, Ltd., Taipei (TW)

( * ) Notice: Subject to any disclaimer, the term of this patent is extended or adjusted under 35 U.S.C. 154(b) by 0 days.

(21) Appl. No.: 10/293,963

(22) Filed: Nov. 12, 2002

(65) Prior Publication Data

US 2004/0090105 A1 May 13, 2004

(51) Int. Cl.[7] ..... A47C 7/02

(52) U.S. Cl. ..... 297/446.2; 297/239; 297/440.1; 297/446.1; 297/411.2; 297/188.8

(58) Field of Search ..... 297/440.2, 440.1, 297/440.22, 440.23, 445.1, 446.1, 446.12, 452.56, 411.26, 411.23, 411.2, 411.43, 411.46, 463.1, DIG. 4; 248/188.8, 188.9; 403/361, 125, 131

(56) References Cited

U.S. PATENT DOCUMENTS

| | | | | | |
|---|---|---|---|---|---|
| 1,581,596 | A | * | 4/1926 | Pettigrew | 297/253 |
| 2,633,899 | A | * | 4/1953 | Armstrong | 297/151 |
| 2,882,958 | A | * | 4/1959 | Monroe et al. | 297/411.42 |
| 3,755,853 | A | | 9/1973 | Barile | |
| 4,209,198 | A | * | 6/1980 | Apple, Sr. | 297/440.23 |
| 4,223,944 | A | * | 9/1980 | DeLong | 297/148 |
| 4,327,461 | A | | 5/1982 | Wisniewski | |
| 4,358,125 | A | * | 11/1982 | Charles | 280/250.1 |
| 4,453,768 | A | * | 6/1984 | Cranford et al. | 297/440.1 |
| 5,123,702 | A | * | 6/1992 | Caruso | 297/440.21 |
| 5,382,080 | A | * | 1/1995 | Gamberini et al. | 297/440.1 |
| 5,439,268 | A | * | 8/1995 | Dozsa-Farkas | 297/441.35 |
| 5,556,170 | A | * | 9/1996 | Lai et al. | 297/463.1 |
| 5,700,053 | A | * | 12/1997 | Downing | 297/227 |
| 5,934,203 | A | * | 8/1999 | Glass | 108/156 |
| 6,168,236 | B1 | * | 1/2001 | Chen | 297/441.2 |
| 6,352,301 | B1 | | 3/2002 | Chu | |
| 6,520,459 | B2 | * | 2/2003 | Burr | 248/188.4 |
| 6,623,082 | B1 | * | 9/2003 | Huang | 297/463.1 |

FOREIGN PATENT DOCUMENTS

| | | |
|---|---|---|
| BE | 397305 A | 7/1933 |
| CH | 339 344 A | 8/1959 |
| DE | 11 94 109 B | 6/1965 |

* cited by examiner

*Primary Examiner*—Peter M. Cuomo
*Assistant Examiner*—Erika Garrett
(74) *Attorney, Agent, or Firm*—Townsend and Townsend and Crew LLP

(57) ABSTRACT

A chair includes a tubular U-shaped back frame. The back frame defines a pair of spaced apart back legs. A pair of tubular L-shaped side members, each of which defines a front leg and an arm, are connected the back legs. A tubular U-shaped seat frame is connected to each of the front legs and each of the back legs. A connecting member is connected across the seat frame adjacent the connections of the seat frame to the back legs.

19 Claims, 4 Drawing Sheets

FIG. 9
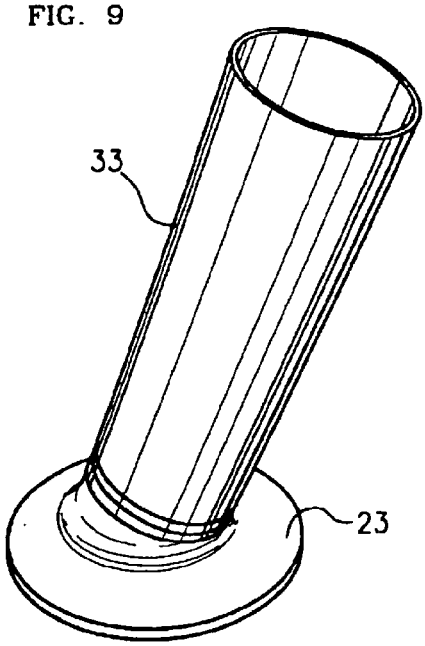
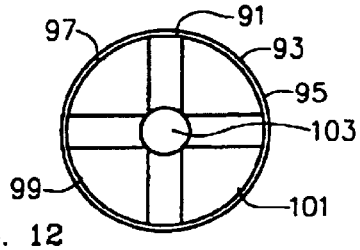
FIG. 12
FIG. 10
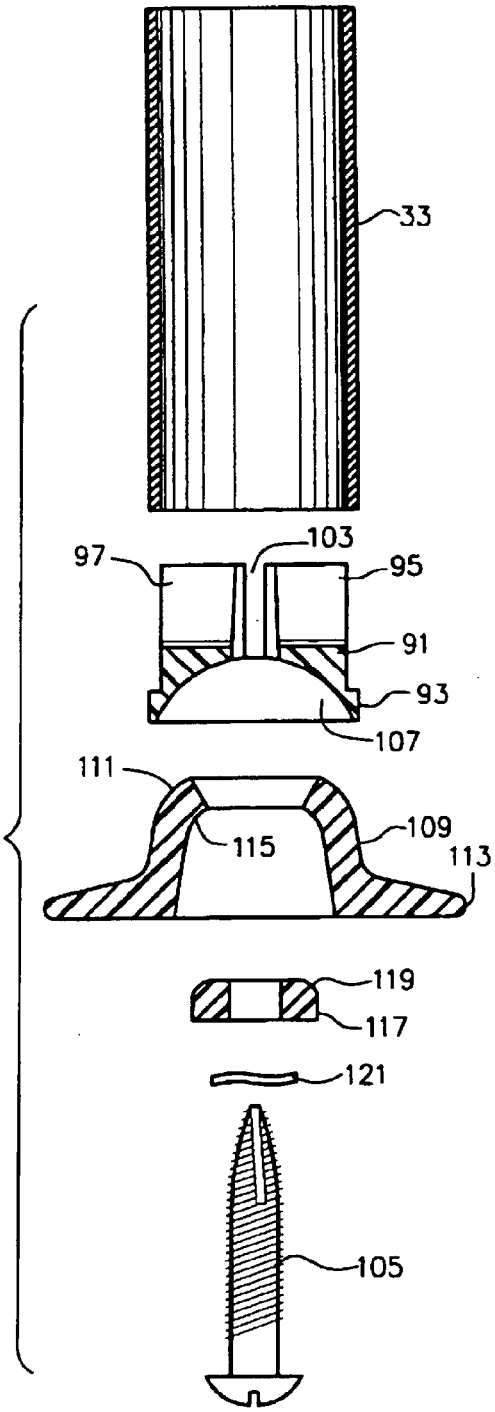
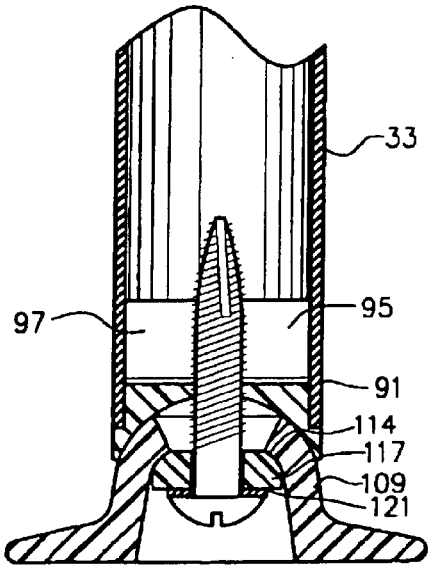
FIG. 11

CHAIR CONSTRUCTION

FIELD OF THE INVENTION

The present invention relates generally to the field of furniture, and more particularly to a tubular chair construction.

BACKGROUND OF THE INVENTION

Tubular chairs are generally well known. Tubular chairs typically include a tubular metal frame, which is welded together, and seat and back members affixed to the frame. Tubular chairs may be used in institutional or commercial settings, such as schools, offices, hotels, convention centers and the like. Tubular chairs may also be used in home settings as extra chairs or as outdoor furniture such as patio furniture and the like.

Tubular chairs need to be relatively rugged, but relatively inexpensive and lightweight. It is difficult to achieve all three of these goals. Particular problems exist in affixing the chair seat and back to the frame. Generally, the seat and back portions are attached to the frame using screws, rivets, or the like. Such connectors tend to become loose or structurally damaged through use. A common material for seat and back portions is molded plastic. Molded plastic often fails in the area of the connectors.

Another problem in conventional tubular chairs is providing suitable feet or the like at the bottoms of the legs. In order to make tubular furniture stackable, it is usually necessary for the legs to be angled rather than vertical. Conventional tubular chairs typically has metal buttons or pads at the bottoms of the legs. It is difficult to connect the buttons or pads such that they are positioned flat on a supporting surface.

Another problem with conventional tubular chairs is providing a suitable arm rest. Typically, arm rests are connected to the chair frame by screws or other fasteners. These fasteners tend to become loose, thereby causing the arm rest to separate from the frame.

SUMMARY OF THE INVENTION

The present invention provides a chair. The chair of the present invention includes a tubular U-shaped back frame. The back frame defines a pair of spaced apart back legs. A pair of tubular L-shaped side members, each of which defines a front leg and an arm, are connected the back legs. A tubular U-shaped seat frame is connected to each of the front legs and each of the back legs. A connecting member is connected across the seat frame adjacent the connections of the seat frame to the back legs.

The seat frame has a circular cross-section and includes a pair of spaced apart side bars and a front bar connected between the side bars. A seat member is mounted to the seat frame. The seat member has a shape and size congruent with the seat frame. The seat member has a front edge and a pair of spaced apart side edges. The front and side edges have a partial circular edge profile adapted to fit with the front and side bars, respectively. The front bar of the seat frame has a pair of spaced apart pin holes. The front edge of the seat member includes a pair of spaced apart pins engaged with the pin holes of the front bar.

The chair of the present invention may have arm rests connected to each said arm. The arms of the arm members have a circular cross-section. The arm rests are generally cylindrical and have an inside diameter substantially equal to the outside diameter of the arm member The arm rest has an axially extending slot having a width less than the outside diameter of said arm member. The arm rest is made of a flexible material such that the arm rest can be snapped onto the arm member, with said arm member passing through said slot. The arm member may have at least one pin hole and the arm rest has a pin engageable with said pin hole.

The chair of the present invention includes a foot pivotally connected to each of the legs. Each of the legs includes a tubular end. A foot according to the present invention includes a plug insertable into an end of a leg. The plug has a partial spherical socket surface. The plug includes leg wall engaging members. A tapered bore extends between the leg wall engaging members. A foot member having a partial spherical ball surface is engageable with the partial socket surface of the plug. The foot member also includes a partial spherical socket surface disposed opposite the partial ball surface. A threaded member is engaged with the bore to hold the partial ball surface of said foot member in contact with said partial socket surface of the plug and urge said leg wall engaging members into engagement with the leg. A washer having a partial ball surface engageable with the partial socket surface of the foot member is disposed between the head of the treaded member and the socket surface of the foot member. The threaded member urges the washer into contact with the foot member.

BRIEF DESCRIPTION OF THE DRAWINGS

FIG. 9 is partial perspective view of a leg and foot according to the present invention.

FIG. 10 is an exploded view of a leg and foot according to the present invention.

FIG. 11 is a sectional view of a leg and foot assembly according to the present invention.

FIG. 12 is a top view of a foot plug according to the present invention.

DESCRIPTION OF THE PREFERRED EMBODIMENT

Figure 1:
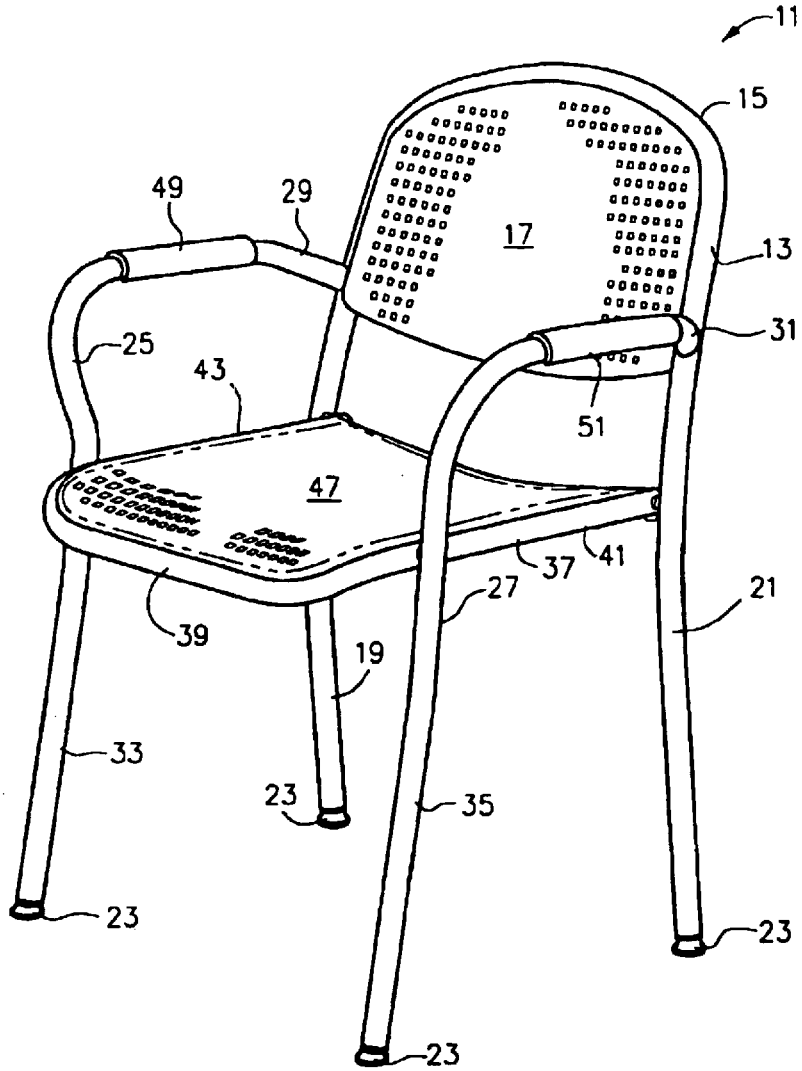
FIG. 1 is a perspective view of a chair according to the present invention.

Referring now to the drawings, and first to FIG. 1, a chair according to the present invention as designated by the numeral 11. Chair 11 includes a tubular generally U-shaped back frame 13. Back frame 13 is made of tubular metal and it includes a seat back portion 15 that supports a seat back 17 and a pair of spaced-apart legs 19 and 21. Seat back 17 is preferably formed from molded plastic or the like. As will be described in detail hereinafter, feet 23 are provided at the ends of legs 19 and 21.

Chair 11 also includes a pair of spaced-apart tubular L-shaped side members 25 and 27. Side members 25 and 27 include generally horizontal arms 29 and 31, respectively. The ends of arms 29 and 31 are connected, preferably by welding, to back frame 13. As will be explained in detail hereinafter, arm members 29 and 31 have a affixed thereto armrests 49 and 51, respectively. Side members 25 and 27 also include leg members 33 and 35, respectively, having feet 23 at their bottom ends.

Chair 11 includes a tubular U-shaped seat frame 37. Seat frame 37 includes a front bar 39 and spaced-apart side bars 41 and 43. Side bar 41 is connected by welding or the like to legs 21 and 35. Similarly, side bar 43 is connected by welding or the like to leg members 19 and 33.

Figure 2:
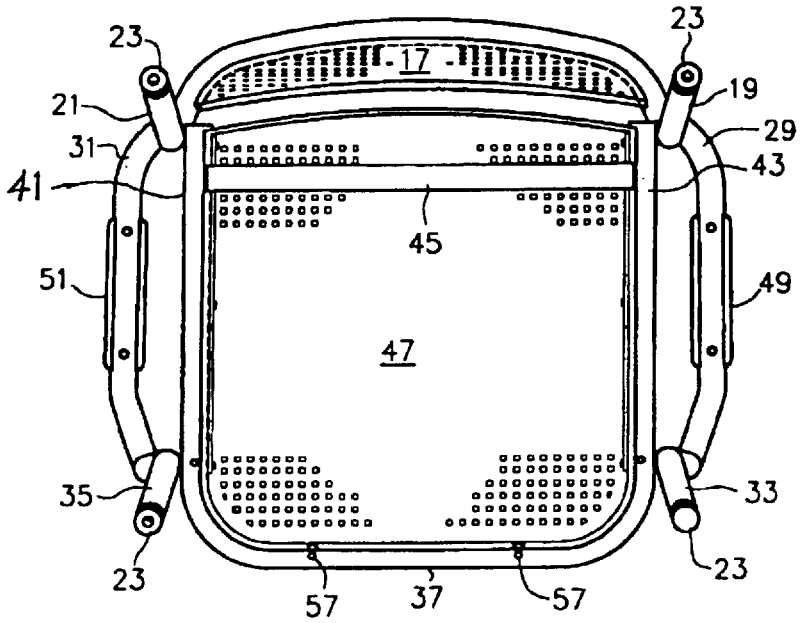
FIG. 2 is bottom view of the chair of FIG. 1.

As will be explained in detail hereinafter, seat frame 37 supports a seat member 47. Seat member 47 is preferably made of molded plastic. As is best shown in FIG. 2, a cross-piece 45 is connected by welding of the leg between side bars 41 and 43 adjacent their connections to legs 21 and 19, respectively. Cross-piece 45 forms a brace between side bars 41 and 43, and between legs 19 and 21. Cross-piece 45 stiffly interconnects both side bars 41 and 43 as well as legs 19 and 21 to resist sagging of seat member 47 and seat back 17, respectively.

Figure 3:
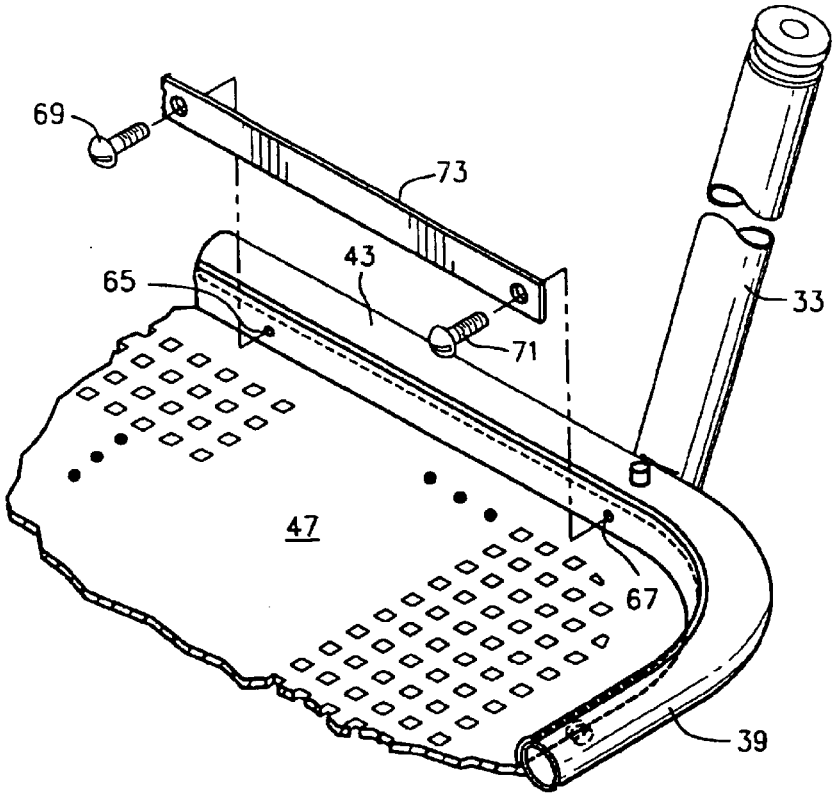
FIG. 3 a partial bottom view of the chair of FIG. 1 showing details of the attachment of a seat member to a seat frame member.
Figure 4:
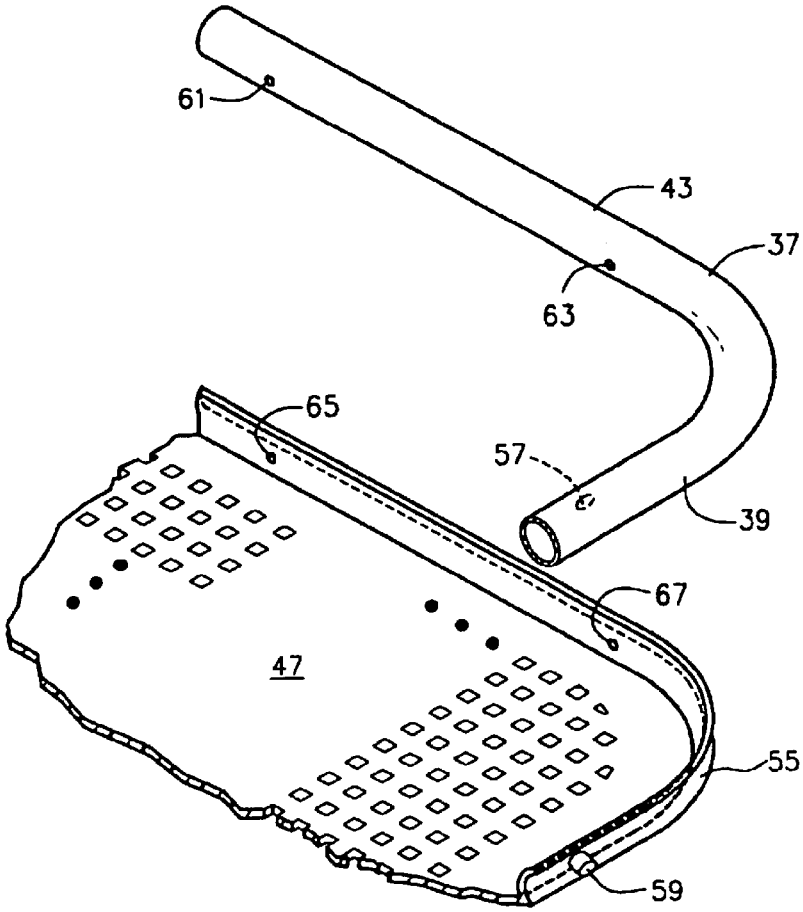
FIG. 4 is a partial bottom view of the chair of FIG. 1 showing further details of the attachment of the seat member to the seat frame member.
Figure 5:
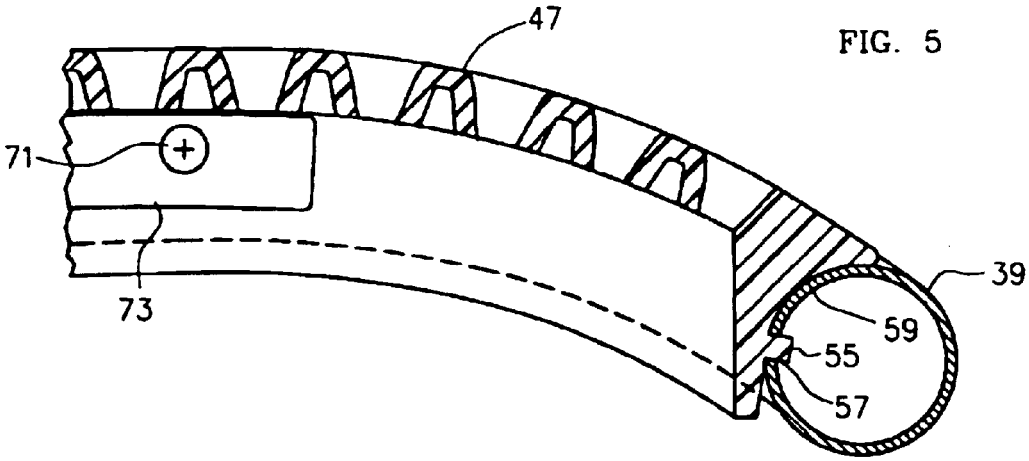
FIG. 5 is sectional view showing further details of the attachment of the seat member to the seat frame member.

Referring now to FIGS. 3–5, there is shown details of the connection of seat member 47 to seat frame 37. Seat member 47 has around its periphery a channel 55 having a circular profile. Channel 55 is adapted to fit with and be supported by seat frame 37. As best shown in FIG. 5, channel 55 extends over the top of front bar 39. In similar fashion, channel 55 extends over the top of side bars 41 and 43. As shown in FIG. 2, and in detail in FIGS. 3–5, front bar 37 has formed therein a pair of spaced-apart pin holes 57. Pin holes 57 are engaged by pins 59 formed in channel 55 of seat member 47. Pins 59 and channel 55 cooperate to support the front edge of seat member 47 with respect to front bar 39.

As shown in FIG. 2, seat member 47 is affixed to each of side bars 41 and 43 by at least three screws. As shown in detail in FIGS. 3 and 4, side bar 43 has formed therein spaced-apart screw holes, two of which are indicated at 61 and 63. When seat member 47 is in position with respect to seat frame 37, holes 65 and 67 seat member 47 align with screw holes 61 and 63, respectively. Seat member 47 is thus connected to side bar 43 by means of screws 69 and 71 engaged with screw holes 61 and 63, respectively. A support bar 73 is positioned to provide support to seat member 47. Support bar 73 spreads the load of screws 69 and 71 over a substantial area of the plastic material of seat member 49. Seat member 47 is connected to side bar 41 in similar fashion.

The combination of seat member 47 and seat frame 37 provides a strong, lightweight and aesthetically pleasing seating surface. The channel 55 and pins 59 cooperate with seat frame 37 and support bar 73 to provide a high strength attachment. Seat back 17 is attached to back frame 13 using a similar combination of a tubular frame, channel and pins.

Figure 6:
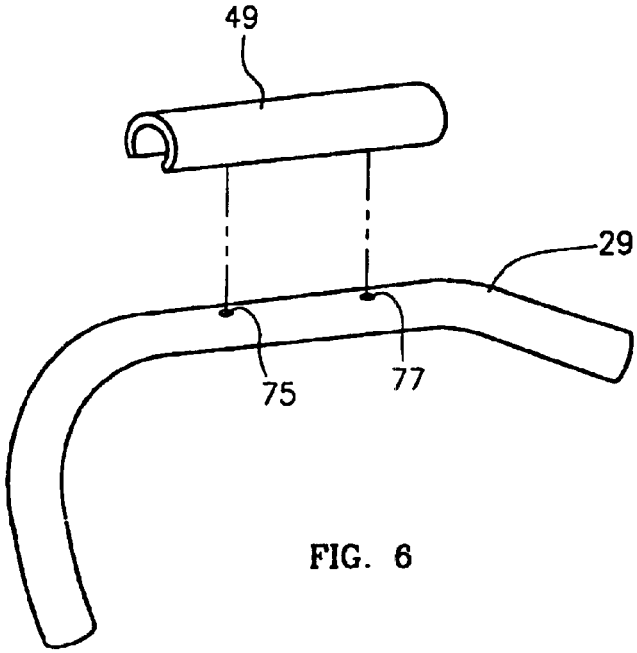
FIG. 6 is an exploded view showing an arm member and arm rest according to the present invention.
Figure 8:
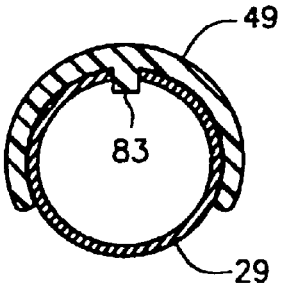
FIG. 8 is a sectional view show an arm rest connected to an arm member.
Figure 7:
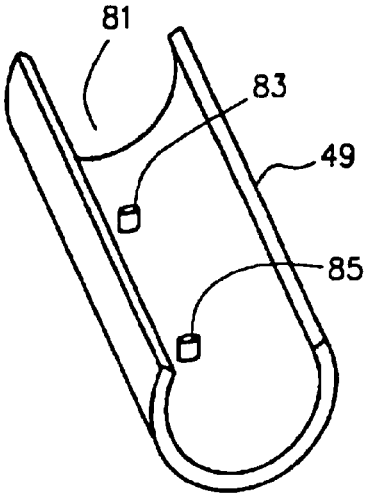
FIG. 7 is a bottom view of an arm rest according to the present invention.

Referring now to FIGS. 6–8, there is shown details of the connection of the arm rest 49 to arm 29. Arm 29 has formed therein a pair of spaced-apart pin holes 75 and 77. Arm rest 49 is generally tubular and has an inside diameter substantially the same as the outside diameter of arm 29. Arm rest 49 has an axial extending slot 81 that has a width less than the outside diameter of arm 29. Arm rest 49 is made of a somewhat flexible material so that it may be snapped into position on arm 29. Arm 49 includes a pair of integrally formed spaced-apart pins 83 and 85. Pins 83 and 85 engage holes 75 and 77 to maintain the axial position of arm rest 49 on arm 29.

Arm rest 49 can be quickly and easily installed on arm 29 without using any tools. A customer or assembler simply positions slot 81 on arm 29 with pins 83 and 85 generally aligned with pin holes 75 and 77. The assembler then press arm rest 49 onto arm 29, which causes slot 81 to spread and snap onto arm 29. If necessary, slight axial adjustment causes the pins to engage the pin holes. Once assembled, arm rest 49 remains solidly affixed to arm 29 over the life of the chair.

Referring now to FIGS. 9–12, there is shown details of a foot 23 and leg 33. Foot 23 includes a generally cylindrical plug 91. The body of plug 91 is adapted to be inserted into the end of leg 33. Plug 91 includes an annular outwardly extending flange 93 that is adapted to engage the bottom of leg 33. In the illustrated embodiment, plug 91 includes four axially extending engagement members 95–101. A tapered bore 103 is formed in plug 91 and between engagement members 95–101. A screw 105 is engageable with tapered bore 103 to urge engagement members 95–101 into engagement with the inner wall of leg 33.

Plug 91 includes an outwardly facing spherical socket surface 107. A foot member 109 has an inwardly facing spherical ball surface 111 that engages socket surface 107. Foot member 109 has a radially outwardly extending foot flange 113 that is adapted to contact a supporting surface. The ball and socket engagement of foot member 109 with plug 91 makes it possible for foot flange 113 to be mounted level with the supporting surface regardless of the angular orientation of leg 33. Foot member 109 has an outwardly facing spherical socket surface 115 a washer 117 having a spherical ball surface 119 is provided. Ball surface 119 engages socket surface 115. A lock washer 121 may be provided.

The foot assembly of the present invention can be assembled with only a screwdriver or hex key by a customer or assembler. The foot is self-leveling to provide a solid footing regardless of angle of the leg. The foot thus can accommodate variation in leg angle in construction or through use. The foot assembly of the present invention finds application in other tubular furniture applications, such as tables.

From the foregoing, it may be seen that the present invention overcomes the shortcomings of the prior art. A chair made according to the present invention is strong, durable, lightweight and aesthetically pleasing. The chair may be assembled quickly and easily by a person of virtually any level of skill without the need for specialized tools. Features of the invention find application in other furniture types besides chairs.

The present invention has been illustrated and described with respect to presently preferred embodiments. Certain features of the invention may be used independently of, or in combination with, other features, all as would be apparent to one skilled in the art.

What is claimed is:

1. A chair, which comprises:

a tubular U-shaped back frame, said back frame defining a pair of spaced apart back legs;

a pair of tubular L-shaped side members, each of said side members defining a front leg and an arm, one of said arms being connected to one of said back legs and the other of said arms being connected the other of said back legs;

a tubular U-shaped seat frame, said seat frame having a circular cross-section and including a pair of space apart side bars and a front bar connected between said side bars, said front bar having a pair of spaced apart pin holes, said seat frame being connected to each of said front legs and each of said back legs;

a connecting member connected across said seat frame adjacent the connections of said seat frame to said back legs;

a seat member mounted to said seat frame, said seat member including a seating surface having a shape and size congruent with said seat frame, said seating surface having a front edge and a pair of spaced apart side edges, said front and side edges having a partial circular edge profile adapted to fit with said front and side bars, respectively, said front edge including a pair of spaced apart pins engaged with said pin hole of said front bar.

2. The chair as claimed in claim 1, including means for connecting said seating surface to said side bars.

3. The chair as claimed in claim 1, including an arm rest connected to each said arm.

4. The chair as claimed in claim 3, wherein each said arm includes at least one pin hole and each said arm rest includes a pin engageable with said pin hole of said arm.

5. The chair as claimed in claim 3, wherein each said arm rest is adapted to snap on to one of said arms.

6. The chair as claimed in claim 3, wherein:

each said arm has a circular cross-section; and, each said arm rest has a greater than semicircular cross section.

7. The chair as claimed in claim 6, wherein said arm rest is of a flexible material such that said arm rest can be snapped onto said arm.

8. The chair as claimed in claim 6, wherein:

each said arm has at least one pin hole; and, each said arm rest has a pin engageable with one of said pin holes.

9. The chair as claimed in claim 1, including a foot connected to each of said legs.

10. The chair as claimed in claim 9, wherein each of said legs includes a tubular end, and said foot includes:

a plug insertable into an end of a leg, said plug having a partial socket surface; and, a foot member, said foot member having a partial ball surface engageable with said partial socket surface of said plug.

11. The chair as claimed in clam 10, wherein said plug includes:

leg wall engaging members; and, a bore in said plug extending between said leg wall engaging members.

12. The chair as claimed in claim 11, wherein said foot includes:

a threaded member threadedly engaged with said bore for holding said partial ball surface of said foot member in contact with said partial socket surface of said plug and urging said leg wall engaging members into engagement with said leg.

13. The chair as claimed in claim 12, wherein said foot member includes a partial spherical socket surface disposed opposite said partial ball surface and said foot includes:

washer having a partial ball surface engageable with said partial socket surface of said foot member, said washer being urged into contact with said foot member by said threaded member.

14. A chair assembly, which comprises:

a tubular U-shaped frame, said frame having a circular cross-section and including a pair of spaced apart first bars and a second bar connected between said first bars, said second bar having a pair of spaced apart pin holes;

a member mounted to said frame, said member having a shape and size congruent with said frame, said member having a pair of spaced apart first edges and a second edge between said first edges, said first and second edges having a partial circular edge profile adapted to fit with said first and second bars, respectively, and said second edge including a pair of spaced apart pins engaged with said pin holes of said second bar.

15. The chair assembly as claimed in claim 14, including a connecting member connected to form a brace between said first bars.

16. The chair assembly as claimed in claim 14, wherein said member defines a seating surface.

17. The chair assembly as claimed in claim 14, including means for connecting said member to said first bars.

18. The chair assembly as claimed in claim 17, wherein said connecting means includes:

a plurality of screws engaging said member and said first bars.

19. The chair assembly as claimed in claim 18, wherein connecting means further includes:

support bars disposed between said screws and said member.

* * * * *